United States Patent [19]

Romero

[11] 4,168,493

[45] Sep. 18, 1979

[54] ALARM SYSTEM FOR A MULTI-FACET INSTALLATION

[75] Inventor: Rocky R. Romero, Metairie, La.

[73] Assignee: Texaco Inc., White Plains, N.Y.

[21] Appl. No.: 843,924

[22] Filed: Oct. 20, 1977

[51] Int. Cl.[2] ..... G08B 19/00

[52] U.S. Cl. ..... 340/521; 340/404; 116/4; 116/266

[58] Field of Search ..... 340/52 F, 517, 519, 340/521, 522, 404, 405, 406; 116/4, 5, 65

[56] References Cited

U.S. PATENT DOCUMENTS

| | | | |
|---|---|---|---|
| 3,014,206 | 12/1961 | Slavin | 116/65 X |
| 3,948,207 | 4/1976 | St. Paul | 16/4 X |

*Primary Examiner*—Alvin H. Waring

*Attorney, Agent, or Firm*—Thomas H. Whaley; Carl G. Ries; Robert B. Burns

[57] ABSTRACT

An alarm system for a multi-facet functional installation in which a malfunction in any segment of the installation will result in the initiation of an audio alarm signal of such a character as to immediately indicate the relative severity of the malfunction.

7 Claims, 1 Drawing Figure

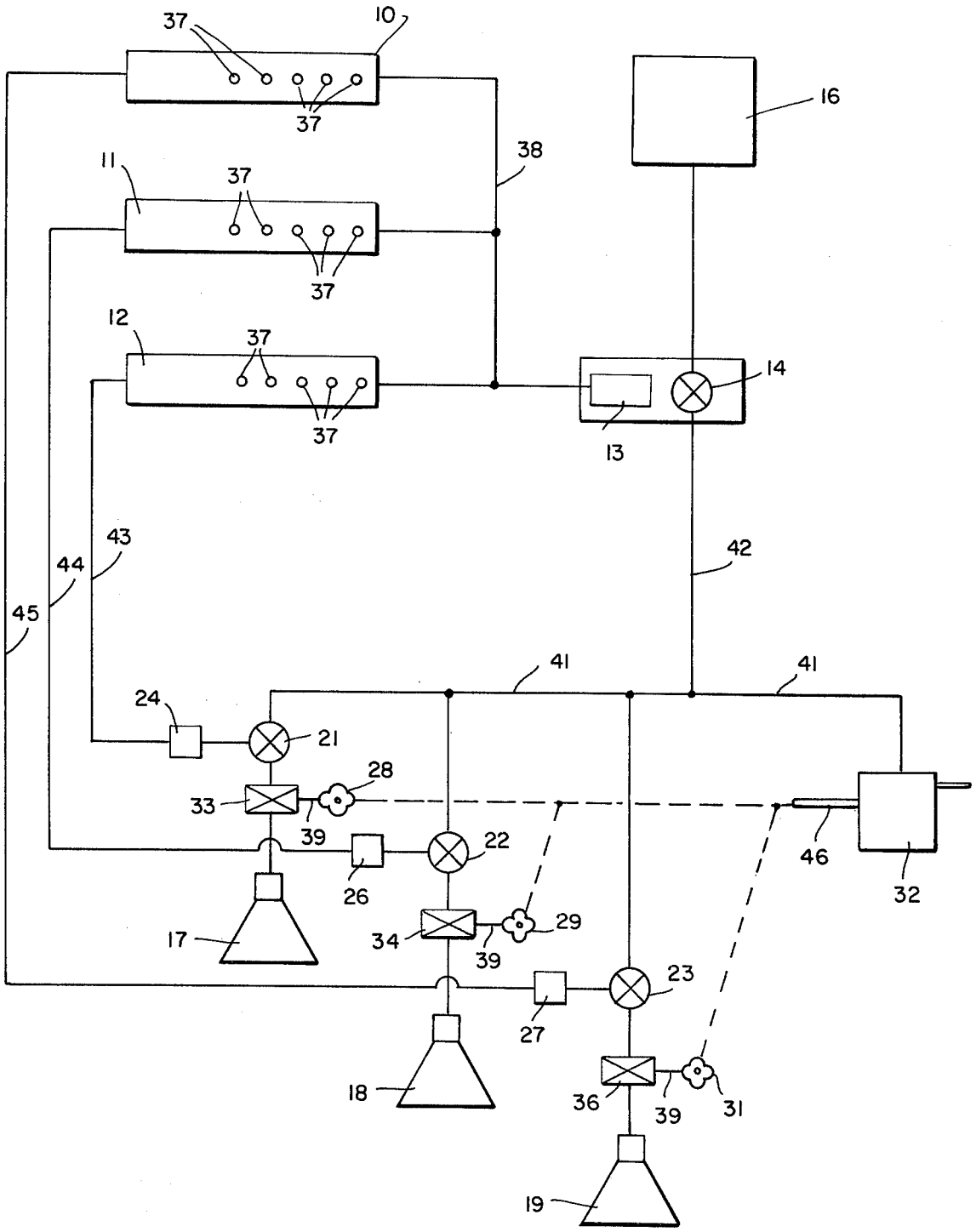
10
11
12
13
14
16
17
18
19
21
22
23
24
26
27
28
29
31
32
33
34
36
37
38
39
41
42
43
44
45
46

ALARM SYSTEM FOR A MULTI-FACET INSTALLATION

BACKGROUND OF THE INVENTION

In any installation which involves a plurality of interconnected and interrelated and mutually dependent segments the provision of a suitable alarm system can represent a number of problems. This is particularly true in the instance of an offshore platform or similar compound integrated structure. In the latter, for example, although the entire unit is relatively compact, there are any number of discrete arrangements and systems and the like within the structure which can be subject to individual malfunctions.

It can be further appreciated that if a malfunction takes place on such a unit, although it may be of some concern, it would not be of such a magnitude as to jeopardize the unit as a whole. On the other hand, the severity of any particular malfunction within a segment might be such as to readily jeopardize the safety ad wellbeing of the unit, as well as of operating personnel.

Usually the alarm system incorporated into any offshore structure of the type contemplated, is such that an audible alarm will be sounded in response to any malfunction that occurs. Such malfunction could be for example the breaking of a high pressure hose, the interruption of electrical service in some portion, or even loss of control of the drilling operation. The latter could result in an uncontrolled flow of oil and/or gas from a well.

A further problem of relevance stems from the usual alarm system relying on electrical power for operation. Thus, even though alternate electrical source might be available, the alarm system could be crippled should a malfunction deprive the alarm of all its power source.

To provide a suitable, integrated alarm system which will cover the entire installation, it is desirable that the system be versatile yet efficient. It should primarily provide an immediate indication to personnel on the unit or in the installation, the relative severity of the malfunction at any particular time. Thus, the measures taken to prepare for, or overcome the malfunction will be of a nature that they are commensurable with the degree of the malfunction's severity.

For example, a relatively small fire in an open area would be serious but certainly not perilous. This is in contrast to the sudden malfunction of the drilling equipment which could cause a runaway well or gas flow which might eventually engulf the entire structure.

Toward providing a more stabilized alarm system that would be indicative of the severity of any malfunction, the present arrangement is provided. Thus, there is disclosed an integrated alarm system which includes a plurality of discrete sensor members. Each of the latter is disposed or position to sense the occurrence of some malfunction on the structure. The respective sensors are further incorporated into groups such that each group represents a severity of malfunction of a different degree that the other groups of sensors.

Each group of sensors is further communicated with a source of an actuating fluid such as compressed air or gas, which in turn is connected to the alarm unit itself. The latter can be a group or array of horns, sirens, or other audible devices, normally utilized for sounding an alarm.

In order that the particular sounded alarm indicating the severity of malfunction might be different from the other sounded alarms, the introduction of an actuating medium to the respective alarm horns is controlled by a code selector unit. A plurality of selector units are thus communicated with valve means which regulates the flow of actuating medium into the respective horns. Thus, as a sensor detects a malfunction of a particular severity, the said sensors will actuate means to initiate a flow of fluid to only the one alarm horn. It will concurrently initiate the flow of fluid to the drive motor which commences the actuation of the code selector members.

It is therefore an object of the invention to provide an integrated alarm system which is capable of indicating the severity of any malfunction or malfunctions which take place within a multi-faceted installation. A further object is to provide an alarm system which is capable of automatically affording any one of a plurality of audio warnings in response to any of a plurality of malfunctions within a multi-faceted installation.

Another object is to provide a relatively simple, yet efficient, alarm system for monitoring a multi-facet installation which embodies a plurality of interrelated and coacting functions.

DESCRIPTION OF THE DRAWINGS

FIG. 1 is a schematic representation of the subject alarm system.

The instant alarm system comprises in brief a series of discrete sensor members which are aggregated into a series of sensor groups 10, 11 and 12. The respective sensor groups are mutually communicated with actuation element 13 of a first valve means 14. A source 16 of an actuating medium, such as compressed gas or air, is communicated with the first valve means 14. The latter is operable to pass a stream of said medium when the valve 14 is in the open position. Thus, actuating medium is introduced to the alarm system proper in response to the opening of valve 14.

The alarm segment of the system comprises an array of alarm units including 17, 18 and 19, which receive actuating media by way of a second valve means 21, 22 and 23. Each of the latter in turn is adjusted to the open position by an actuator 24, 26 and 27 in response to a signal or impulse received from any one or more of the above-noted sensor groups 10, 11 or 12.

A code selector mechanism includes a series of motor driven selector members 28, 29 and 31 which are mutually connected to a prime mover 32. As the latter is operated, the respective selector members function to open a control valve such as 33, 34 and 36. The result is that a particular alarm unit is actuated to produce a distinct audio sound.

Referring to the diagram, the respective sensor member groups 10, 11 and 12 can comprise any number of individual elements which are adapted to sense a particular malfunction. For example, normally such elements are sensitive to any of a number of conditions such as heat, liquid level, and a sudden rise or decrease in pressure, or loss of power. In summary, the selector members can be chosen from any one of a group of units known to the industry. The units are thus capable of detecting a malfunction or unusual condition which would suggest an emergency situation at a particular point in an installation.

The respective sensor members 37 are aggregated into compatible groups. Each group comprises sensors which are commonly connected, and disposed at points in the installation having a common degree of criticality should an emergency arise at any one or more of said points. Thus, each sensor 37 would be classified in a common category with other sensors in that group.

For example, the respective sensors might be connected to various high pressure lines, and pieces of equipment and the like about the installation, any one of which, if ruptured or otherwise disabled, could initiate an emergency situation of comparable severity or level of criticality.

In one embodiment, each sensor 37 could be communicated with a common valve which would mutually regulate the flow of actuating medium. However, the respective sensor groups 10, 11 and 12 as shown in the FIGURE, can also be commonly communicated to a manifold 38.

Manifold 38 is in turn communicated with the actuating element 13 of first control valve means 14. The latter includes an inlet communicated with the source of an actuating medium 16 which is as noted, a compressed gas, and more preferably compressed air. Functionally, said first valve means 14 is normally held in a closed position. Further, it is only actuated to the open position for passing a stream of compressed actuating medium therethrough at such time as actuator 13 received an impulse from one or more of the sensors 37.

First valve means 14 is communicated to alarm units 17, 18 and 19. The invention is presently addressed to the use of an audio system made up of the above-noted units. However it is understood that the alarm system can embody any one or more groups of elements capable of providing other than an audio signal.

Further, although the alarm units will be hereinafter referred to as horns, any one of a variety of such members could be used as well. For example the system could embody an array of alarm bells, sirens, whistles and the like. Also included are the instrumentations for initiating non-audible signals. In the present arrangement each horn member 17, 18 and 19 is provided with a control valve 33, 34 and 36. The latter control the flow of actuating medium which enters the horn. Thus, the respective horns are adapted to provide an audio sound of a particular pitch or frequency in response to the entry of said medium, and only during the passage of said medium into or through the horn.

The horn control valve 33, for example, is provided with inlet means communicated with the source of the actuating medium 16. An outlet is communicated to the horn diaphragm, chamber, or the like. Said control valve 33 is provided with an outwardly extending arm or lever 39. Said member is capable of switching the operation of the valve from a no-flow position to a full flow position. In the latter position, actuating medium can flow therethrough.

Each horn 17 is further provided with a second control valve means 21, 22 and 23, which includes a second valve means actuator 24, 26 and 27 respectively. As shown, the source of actuating fluid 16 is communicated through a common line 41 to a manifold 42, by way of first control valve means 14. Thus, a flow of actuating fluid to the respective horns 17, 18 and 19 is controlled not only by the main control valve 14 but also by actuation of secondary valve members 21, 22 and 23.

Each secondary valve member 21 is provided with a secondary valve means actuator 24. Thus, each of the secondary valve means is normally in closed position to avoid flow of actuating fluid therethrough. Said valves are adjusted to open position, however, in response to the sensor control actuator 24. Actuator member 24 is communicated by line 43 to one of the group of the sensors, in this instance sensor group 12. Thus, any emergency which arises at a point in the installation at which one of the sensors 37 in said group 12 is located, will cause only secondary valve means 21 to be adjusted to open position. Concurrently, valve 14 will be actuated to open position.

Similarly the group of sensors embodied within the sensor array 11 is communicated exclusively by line 44 through valve 22, to horn 18. Consequently, any emergency situation which arises in a sector of the installation at which any of the sensors in group 11 are located, will provide an impulse at the horn 18. The audio signal provided by horn 18 is distinctly different from the comparable signal provided by either of the other horns 17 or 19.

To actuate the proper horn in response to a signal from one of the sensor arrays 10, 11 or 12, selector means is provided. The latter includes at least one prime mover such as gas driven motor 32 which is drivingly connected to an elongated shaft 46. Motor 32 is directly connected through suitable gearing or other speed reducing means such that shaft 46 will rotate at a compatible speed.

Shaft 46 is provided with a plurality of selector members such as outwardly extending arms or cams 28, 29 and 31. In the latter instance each cam, such as 28, is provided with a peripheral contact surface which slidably engages the movable arm 39 of control valve 33. Thus, as the respective selector cams 28, 29 and 31 are mutually driven by the one prime mover 32, each of the control valves 33, 34 and 36 will be periodically adjusted to the open position in response to displacement of the valve's movable arm 39.

Each of the cams 28, 29 and 31 is provided with a distinctive profile or peripheral contact surface, which differs from the surface of each other cam. Thus, each of the respective alarm horns 17, 18 and 19 will, upon actuation, emit a signal the character of which is distinctive from the signals of each of the other horns.

Operationally then, when an emergency condition arises in the installation it will affect any one of the sensors 37 within a particular sensor group. For example, the sensor 37 will then be activated to initiate a pulse. The latter is immediately directed to the first valve means actuator 13 by way of common manifold 38. This sensor pulse will cause first valve 14 to adjust to the open position, thereby initiating a flow of actuating medium from source 16 and line 42, to both the horn array and to motor 32.

Concurrently, the same sensor will initiate a pulse or signal to second valve actuator 26. Thus, the second valve means 22 will be adjusted to the open position. The actuating medium supplied to motor 32 will thereby commence movement of the selector mechanism. Further, the flow of actuating medium introduced by valve 22 will enter control valve 34 upon opening of said second valve means.

As the selector mechanism operates, cam 29 will cause the control valve arm 39 to be displaced at a frequency which conforms to the peripheral surface of the selector cam 29. Horn 18 will thereby receive an intermittent flow of actuating medium, thereby providing an intermittent audio signal from said horn.

It can be seen then that personnel on any installation or on the offshore platform, upon hearing a particular audio alarm signal, will be immediately alerted to the type of emergency which has arisen. This will permit said personnel to take appropriate steps or actions which might be either preprogrammed, or predetermined such that the emergency which has arisen can best be met or overcome with the greatest efficiency and in a manner to avoid any major damage to the installation.

Other modifications and variations of the invention as hereinbefore set forth can be made without departing from the spirit and scope thereof, and therefore, only such limitations should be imposed as are indicated in the appended claims.

I claim:

1. Alarm system for detecting an emergency condition within a multi-segment installation, said system being capable of providing a distinctive alarm signal of a character to instantaneously indicate the severity of an emergency condition which has been detected, as distinguished from other emergency conditions, said system including;

sensor means comprising discrete sensor members disposed about the multi-segment installation, in those segments of the latter where an emergency condition could arise, said discrete sensor members being operable to establish an impulse when said emergency condition does arise, an alarm array comprising a plurality of discrete alarm units, each unit being operable by introduction thereto of an actuating medium to provide an audio signal of a character which differs from the audio signal provided by each other alarm unit in the alarm array, first valve means connected to said sensor means and said alarm array respectively, being operable to initiate a flow of said actuating medium from a source thereof, to the alarm assembly, and selector means engaging said alarm array, and being operable to allow introduction of actuating medium only to that particular alarm unit in said alarm array which corresponds to that sensor unit which has formed an impulse in response to an emergency condition.

2. In an apparatus as defined in claim 1, wherein said source of actuating medium comprises a supply of a compressed gas.

3. In an apparatus as defined in claim 1, wherein said source of actuating medium comprises a supply of compressed air.

4. In an apparatus as defined in claim 1, wherein said first valve means includes a valve member having an inlet communicated with said source of actuating medium and an outlet communicated with said alarm assembly and code selector apparatus, respectively.

5. In an apparatus as defined in claim 4, wherein said first valve means includes an actuator communicated thereto for adjusting said valve from a normally closed position to a normally open position, said actuator being communicated to said sensing group.

6. In an apparatus as defined in claim 1, wherein said respective sensor groups are mutually communicated to a common manifold, said manifold being further communicated with said valve actuator.

7. In an apparatus as defined in claim 1, wherein said horn control switch includes a control arm, said selector members including a shaft mounted cam having a distinct surface pattern thereon disposed in operable engagement with said control arm to displace the latter.

* * * * *